US005094379A

United States Patent [19]

Hoyer et al.

[11] Patent Number: 5,094,379

[45] Date of Patent: Mar. 10, 1992

[54] COPIER WITH ON-LINE AND CONVENIENCE STAPLERS WITH SHARED POWER SUPPLY

[75] Inventors: August Hoyer, Penfield; Edward T. Bloomer; Thomas E. Bitter, both of Rochester, all of N.Y.

[73] Assignee: Xerox Corporation, Stamford, Conn.

[21] Appl. No.: 645,851

[22] Filed: Jan. 25, 1991

[51] Int. Cl.[5] ..... B27F 7/36

[52] U.S. Cl. ..... 227/2; 227/7; 227/8; 227/78; 270/53; 412/6

[58] Field of Search ..... 227/2, 5, 6, 7, 8, 78, 227/131; 270/37, 53; 271/287; 412/6; 355/324

[56] References Cited

U.S. PATENT DOCUMENTS

| | | | |
|---|---|---|---|
| 3,221,964 | 12/1965 | Mestre | 227/5 |
| 4,157,778 | 6/1979 | Villwock et al. | 227/78 |
| 4,318,555 | 3/1982 | Adamski et al. | 227/7 |
| 4,516,714 | 5/1985 | Braun et al. | 227/78 |
| 4,750,661 | 6/1988 | Pane | 227/78 |
| 4,795,071 | 1/1989 | Jacobs et al. | 227/7 |
| 5,012,967 | 5/1991 | Johansson | 227/78 |

*Primary Examiner*—Frank T. Yost
*Assistant Examiner*—Scott A. Smith

[57] ABSTRACT

A copier or printer providing regular automatic on-line stapling of the output sets of copies, yet also providing a separate, easily manually accessible, convenience stapler, driven by the same power supply but on a controlled power sharing basis, saving the cost of a separate, or higher power, stapler drive power supply. This is accomplished without any interference with, or delay in, the operation of the on-line output stapling, without overloading of the shared power supply, and without operator-perceptible interference with the operation of the separate convenience stapler. The operation of the internal copy set stapler is prioritized to avoid throughput loss and only briefly, e.g., for one second or less, is coincident driver power for the convenience stapler inhibited, i.e., only for a time period sufficient for the power pulse to the finisher stapler to be generated and provided, and only if overlap in power usage would otherwise occur.

13 Claims, 1 Drawing Sheet

COPIER WITH ON-LINE AND CONVENIENCE STAPLERS WITH SHARED POWER SUPPLY

Figure 1:
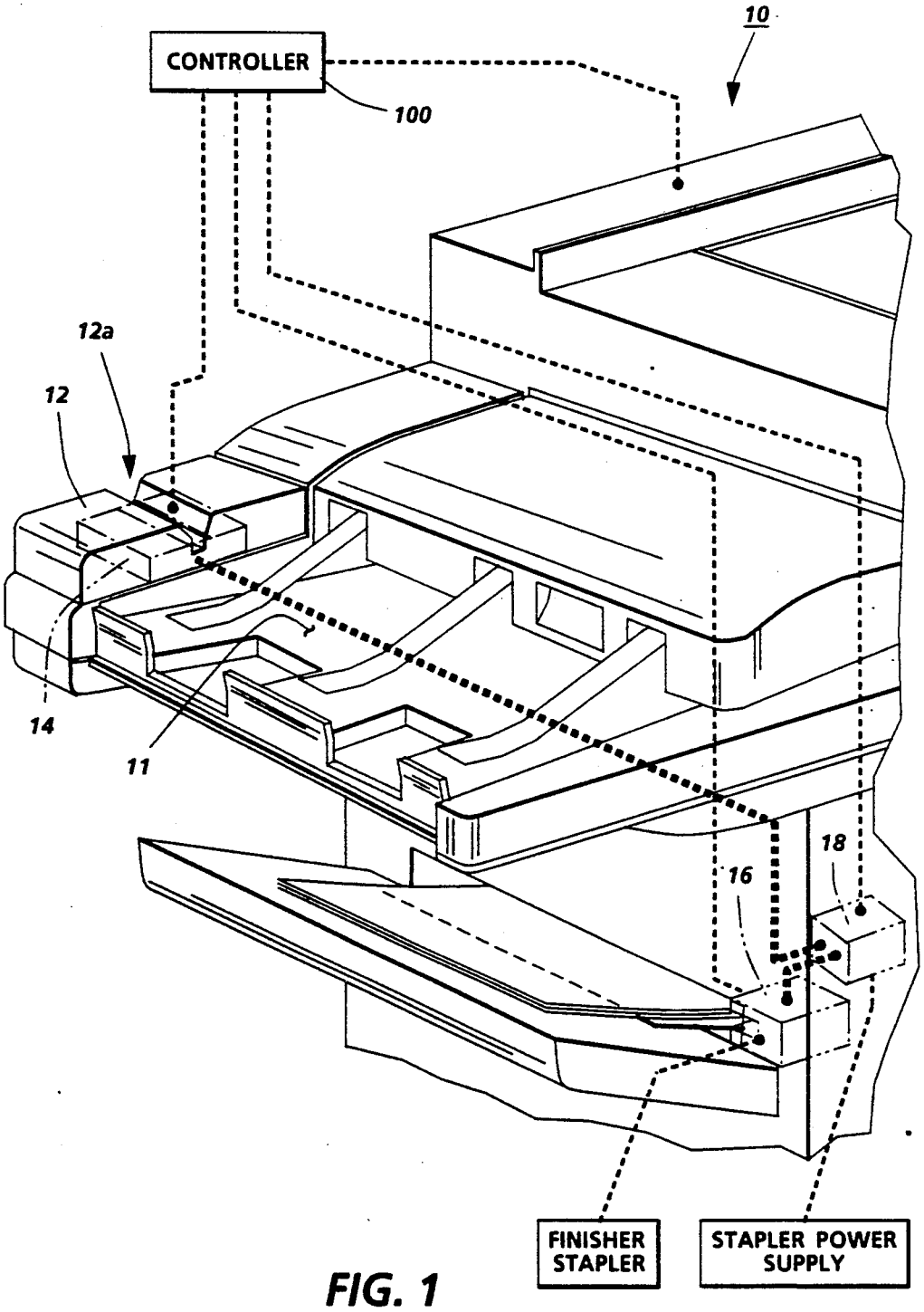

Disclosed herein is an improvement in copiers or printers, for providing regular automatic on-line stapling of the output sets of copies, yet also providing a separate, easily operator accessible, convenience stapler. As disclosed herein, this additional stapler may desirably be driven by the same, shared power supply, saving the cost of a separate stapler drive power supply. As further disclosed herein, this may be accomplished without interference with, or delay in, the operation of the on-line stapling, without overloading of the shared power supply, and without operator-perceptible interference with the operation of the separate convenience stapler.

The disclosed embodiment example provides for prioritized noncoincident sharing of a single staple driver power supply by two separate staplers on the same reproduction unit-a convenience stapler and an online copy output set stapler. The automatic internal copy output set stapler may be prioritized to avoid throughput loss by inhibiting coincident use of the preferably top-accessible convenience stapler when the power pulse is being generated and provided for the driver of the internal on-line copy output set stapler. Yet this separate convenience stapler may be allowed effectively shared use of the same power supply at all times with no user perceived interruption. It was observed that if two or more of the relatively large electrical power pulses required to drive an electric stapler were to be required simultaneously, or even if one was required during a power storage charging cycle for the other, that this would inherently require a much larger capacity and more expensive power supply if more than one stapler were to be so simultaneously operated off the same supply.

Another advantage of the disclosed system is that the overall maximum electrical power consumption and power resources of the copier or printer need not be increased. That is particularly desirable in customer locations or countries where the line power consumption is limited, or line pulses are restricted, or the site line power outlet consumption is already in maximum use by other machine components, and additional requirements on the system power supply could become a restraining factor in the installation of a stapler.

Various types of electrically driven staplers, and on-line staplers for copiers, are well known in the art, both single station and in-bin, and thus need not be described herein. The following patent disclosures are noted by way of examples. As noted in Xerox Corporation U.S. Pat. No. 4,782,363 (D/87203), at Col. 13, after a discussion of the various on-line finishing systems, some examples of prior automatic on-line collating copier finishers (staplers, stitchers, gluers or other binders) and/or offsetters and their controls, are disclosed in U.S. Pat. Nos. 3,630,607 issued Dec. 28, 1971 to H. Korn et al.; 3,793,016 issued Feb. 19, 1974 to R. N. Eichorn; 4,134,672 issued Jan. 16, 1979 to L. B. Burlew et al.; 4,328,919 issued May 11, 1982 to B. R. Lawrence et al.; 4,344,544 issued Aug. 17, 1982 to T. Cross; 4,398,986 issued Aug. 16, 1983 to Robert C. Smith et al; 4,516,714, issued May 14, 1985 to Oskar J. Brahm; 4,328,919 issued May 11, 1982; and "Research Disclosure Journal" publications Nos. 22733 and 22734 on pages 120–134 of the March 1983 issue (anonymous). Also, Xerox Corporation U.S. Pat. No. 3,884,408 issued May 20, 1975 to L. L. Lieter, et al; and U.S. Pat. No. 4,087,087 issued May 2, 1978 to John H. Looney. Also, Xerox Corporation U.S. Pat. Nos. 4,417,801 and 4,541,626; and Canon 4,928,941. Other art of background interest noted included U.S. Pat. Nos. 4,361,393 and 4,603,971. Also, Xerox Corporation U.S. Pat. Nos. 4,592,651 and 4,595,187 are noted re alternative signature sets (centerline) stapling.

If desired, copy sets can be forwarded out of the disclosed finisher on to anadditional finishing station if desired. For example, to a hole puncher, ring binder, GBC binder, or the like.

Of particular note, some of the copier on-line stapler art also discloses the alternative use of the same stapler for a convenience stapler (allowing optional manually inserted stapling or re-stapling of copy sets or document sets), as in Xerox Corporation U.S. Pat. Nos. 4,925,171 by Kramer, et al (D/87219); and Canon 4,878,656 to Honjo, et al, issued Nov. 7, 1989.

In particular, there is noted re optional convenience stapling in a copier with on-line stapling a Xerox Corporation Xerox Disclosure Journal publication of July/August 1983, Vol. 8, No. 4, pp. 309–11.

As to specific hardware components of the subject apparatus, it will be appreciated that, as is normally the case, some such specific hardware components are known per se in other apparatus or applications. For example, it is known, of course, in general, to provide for fully simultaneous sharing of power for various xerographic or other functions in a copier, as in Xerox Corporation U.S. Pat. No. 3,967,892, Col. 7, lines 56–63, for example, or in various other devices or systems. Electrically driven staplers, their operation, and their power supplies, are well known per se, and widely commercially available, and need not be described herein. Nor is the present system limited to, dependent on, or preferring, any particular stapler or power supply. A couple of stapler power supply examples are shown in Xerox Corporation U.S. Pat. No. 4,558,391 to Ward et al, and the Xerox Disclosure Journal publication of January/February 1984, Vol. 9, No. 1, pp. 11–12. However it is believed that the large intermittent power pulse of an electric stapler would require a larger capacity and more expensive power supply if more than one stapler were to be simultaneously operated off the same supply.

A specific feature of the specific embodiment(s) disclosed herein is to provide, in a reproducing apparatus and method for outputting reproduced sets of reproduction sheets at a sets output area, with an intermittently electrically driven finishing stapler in said sets output area for automatic periodic stapling of the output sets, which finishing stapler is intermittently driven by a stapler power supply providing driving power thereto; the improvement comprising: a separate, additional, electrically driven convenience stapler for casual user operation on manual sheet insertion or other demand, said separate convenience stapler being mounted to said reproducing apparatus at a separate easily manually exteriorly accessible location, said separate convenience stapler being electrically driven by said same stapler power supply, on a controlled noncoincident basis relative to said finisher stapler, by inhibiting operation of said convenience stapler for a brief inhibition time period when said stapler power supply is providing said driving power for said finisher stapler, which inhibition time period is sufficiently brief that there is no significant operator-perceptible time delay in said operation of said separate convenience stapler on operator demand.

Further specific features disclosed herein, individually or in combination, include those wherein said brief inhibition time period of said convenience stapler corresponds to the time period required for said stapler power supply to generate and then provide a stapler driving pulse to said finisher stapler; and/or wherein said inhibition time period starts before the time at which said finisher stapler is electrically driven; and/or wherein said inhibition time period of said convenience stapler has a maximum time period of approximately one second or less; and/or wherein said inhibition time period occurs only if said demand of said separate convenience stapler occurs during a time period required for said stapler power supply to generate and provide a stapler driving pulse to said finisher stapler, and wherein said time periods required for said stapler power supply to generate and provide a stapler driving pulse to said finisher stapler occur intermittently with a periodicity substantially greater than said brief inhibition time period; and/or wherein said automatic operation of said finisher stapler always has priority over said operation of said separate convenience stapler to avoid any delay in said outputting of reproduced sets by said reproducing apparatus; and/or wherein said separate convenience stapler is mounted to and accessible for stapling from the top of said reproducing apparatus adjacent a restacking tray for copied documents also provided on top of said reproducing apparatus; and/or wherein reproducing apparatus automatically staples output sets of reproduction sheets with an intermittently electrically driven finishing stapler at a sets finishing area into which said output sets are automatically fed, which finishing stapler is intermittently driven by a stapler power supply providing driving power thereto.

The disclosed apparatus may be readily operated and controlled with conventional copier or printer control systems. Some additional examples of such control systems, including sheet detecting switches, sensors, etc., are disclosed in U.S. Pat. Nos. 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general and preferable to program and execute such control functions and logic with conventional software instructions for conventional microprocessors. This is taught by the above and other patents and various commercial copiers. Such software may of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hardwired logic or switching systems. As shown in the above-cited art, the control of exemplary document and copy sheet handling systems in copiers may be accomplished by conventionally actuating them by signals from the copier controller directly or indirectly in response to simple programmed commands and from selected actuation or non-actuation of conventional copier switch inputs. The resultant controller signals may conventionally actuate various conventional electrical solenoids or the like in the copier in the selected steps or sequences as programmed.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus the present invention will be better understood from this description of an embodiment thereof, including the drawing figure (approximately to scale, except for the schematic portions) wherein:

FIG. 1, the FIGURE, is a partially schematic perspective view of one embodiment of the disclosed dual stapler and power supply sharing system.

In this Figure, there is show a portion of otherwise conventional copier or other reproducing machine 10 by way of example of one application of the disclosed dual stapler and power supply sharing system.

In this example, a separate convenience stapler 12 is shown as an integral part of the overall copier or printer 10 external or cover architecture, in addition to the conventional output finisher stapler 16. Specifically, as part of (at the rear of) the document feeder output tray 11. That places the convenience stapler 12 desirably on top of the machine 10, and closely adjacent the location where copied documents which may need to be re-stapled are collected. Here, the convenience stapler 12 is mounted vertically, providing the operator with easy access to the stapling operation. A slot **12*a* in the stapler 12 cover provides the sheet insertion entrance to the stapler 12. The slot 12*a* has a wider opening at the top for ease of manually inserting up to 50 sheets of even curled paper. Then preferably the slot 12*a* narrows or tapers down to near at the staple head location of the stapler mechanism 14 to only allow the width of, for example, a 50 sheet stack, for safety. The stapler 12 may be hinge mounted and swung horizontal for loading staple cartridges. Appropriate conventional interlock devices may be provided for safe operation of this off-line convenience stapler 12. This location and configuration allows for simple, safe, side or corner set stapling, since the copy or document set may easily be inserted down into slot 12*a* in any desired orientation. However, this is only one example of various possible easily user accessible locations of the convenience stapler 12**.

Also, in this two separate staplers system, the finisher stapler 16 can be desirably fixed in a desired output location. Thus the finisher stapler 16 does not need to be movable up to a more user accessible location, which eliminates any hardware and time delays which would be required for that. And both staplers 12 and 16 are always available for immediate use.

To avoid the need for an separate power supply here there is sharing of power by the convenience stapler 12 with the already existing power source 18 of the (typical internal on-line) output sets finisher stapler 16. The operation of both staplers 12 and 16 may be conventionally controlled by appropriate software, with only a brief inhibit of simultaneous operation, as described. The finisher stapler 16 preferably always has priority over the convenience stapler 12 in the case where both staplers are coincidental actuated to be used in the very same time frame. Conventional software can provide the controlling function to briefly gate the operation of the convenience stapler 12 to achieve this power sharing requirement without interrupting throughput. That is, not to delay the normal operating time of the finisher stapler 16. The set insertion switch input signal of stapler 12 can be ignored, or stored and delayed briefly (buffered), or, preferably, the driver pulse firing signal from the power source 18 in response to the set insertion switch input signal of stapler 12 can be delayed (gated) in the case where it would otherwise overlap with the providing of power to the other stapler 16.

To further describe the operation and structure, as shown in the Figure, the convenience stapler 12 is mounted on top of the machine 10 for convenient access by the operator. It is at the rear of the document output tray 11 here. The document or copy set to be stapled may be inserted in any desired orientation in the entrance slot 12*a* of the convenience stapler 12. If corner stapling is desired, the sheets are inserted corner first. The insertion of the sheets triggers a conventional stapler actuation switch therein near the staple jaws. The internal stapler 12 mechanism 14, shown schematically in phantom, is desirably a conventional commercial stapling unit. For example, the well-known Max Corporation of Japan stapler used in many copiers.

The exemplary output stapler 16, also shown in phantom, may be of the same type. By using the same stapler mechanisms in both locations, the same staples can be used in both staplers, which is a customer desirable feature. Both staplers 12 and 16 here are preferably driven from the same stapler electrical power supply 18, which is preferably a generally conventional power supply of the capacitive charging type, as in the above-cited art, or otherwise. The power supply 18 is one which would normally be provided for, and capable of, driving a single stapler unit. Here, by an appropriate software controlled time-sharing arrangement, this same power supply 18 operates both the stapler 12 and the stapler 16. The stapler 16 is actuated in accordance with the normal operation of an online copier or printer. That is, a stapling signal is conventionally provided to the stapler power supply 18 when a set has been produced and compiled and is ready for stapling. This is conventionally provided by the machine 10 controller 100 in a conventional manner. In normal machine 10 operation the output stapler 16 only operates after the selected number of copies has been printed and compiled in the set compiler or sorter bins. Thus its frequency of operation is normally much less than the copy printing rate of the machine 10. Also, when the stapler 16 does operate it does so rapidly, e.g., in less than 800 milliseconds. The use of the convenience stapler 12 is normally much less often. Thus, it has been found that the odds of the output stapler 16 and convenience stapler 12 being operated and drawing power at the same time are minimal. However, it cannot be ignored, due to the factors previously noted.

In the present system the operator may use the top stapler 12 at any time he or she desires. As a practical matter, the operator is never aware of any delay in operation of the stapler 12 or the intermittent non-enablement of the stapler 12. That is because, in the present system, even in the unlikely event that the input switch at the input 12*a* of stapler 12 is actuated by a sheet set insertion at the identical time that a stapling signal indicates that power is required for the output stapler 16, the maximum delay (inhibit time) the operator would ever experience at the stapler 12 is only about one second or less. In most cases there is no delay or inhibit time at all, since, as noted, the time periods required for the stapler power supply to generate and provide a stapler driving pulse to the finisher stapler 16 are less than a second, and occur only intermittently with a widely spaced periodicity of several seconds or more, which is substantially greater than the brief inhibition time period. I.e., normally there is no potential coincidence or potential power demand overlap. A one second inhibit allows ample time for the operation (power application to) the stapler 16, and also desirably includes approximately 400 milliseconds of stapler 12 inhibit time provided in advance of (started before) the stapler 16 operation. That advance inhibit allow full recharging of a capacitor in the stapler power supply 18, if that type of power supply is used, which it is desirable to do, since it reduces pulsing and peak demands on the power line.

Thus, only in relative rare potential coincident use cases, and then only briefly, e.g., for one second or less, is driver power for the convenience stapler 12 inhibited. That is a time period sufficient for the power pulse to the finisher stapler 16 to be both generated and then applied to the stapler solenoid for stapling.

This maximum total delay of one second or less has been found experimentally to be effectively "invisible" to the operator. It has been found that the operator simply assumes that the set being inserted at slot 12*a* in the stapler 12 has not yet been fully inserted therein, or that the stapler 12 has not yet been actuated by the insetion, since some delay is inherent in so doing even in a normal instantaneously powered stapler.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a reproducing apparatus for outputting reproduced sets of reproduction sheets at a sets output area, with an intermittently electrically driven finishing stapler in said sets output area for automatic periodic stapling of the output sets, which finishing stapler is intermittently driven by a stapler power supply providing driving power thereto; the improvement comprising:

a separate, additional, electrically driven convenience stapler for casual operator operation on demand, said separate convenience stapler being mounted to said reproducing apparatus at a separate easily manually exteriorly accessible location, said separate convenience stapler being electrically driven by said same stapler power supply, on a controlled non-coincident basis relative to said finisher stapler, by inhibiting operation of said convenience stapler for a brief inhibition time period when said stapler power supply is providing said driving power for said finisher stapler, which inhibition time period is sufficiently brief that there is no significant operator-perceptible time delay in said operation of said separate convenience stapler on operator demand.

2. The reproducing apparatus of claim 1, wherein said brief inhibition time period of said convenience stapler corresponds to the time period required for said stapler power supply to generate and then provide a stapler driving pulse to said finisher stapler.

3. The reproducing apparatus of claim 2, wherein said inhibition time period starts before the time at which said finisher stapler is electrically driven.

4. The reproducing apparatus of claim 1, wherein said inhibition time period of said convenience stapler has a maximum time period of approximately one second or less.

5. The reproducing apparatus of claim 1, wherein said inhibition time period occurs only if said demand of said separate convenience stapler occurs during a time period required for said stapler power supply to generate and provide a stapler driving pulse to said finisher stapler, and wherein said time periods required for said stapler power supply to generate and provide a stapler driving pulse to said finisher stapler occur intermittently with a periodicity substantially greater than said brief inhibition time period.

6. The reproducing apparatus of claim 1, wherein said automatic operation of said finisher stapler always has priority over said operation of said separate convenience stapler to avoid any delay in said outputting of reproduced sets by said reproducing apparatus.

7. The reproducing apparatus of claim 1, wherein said separate convenience stapler is mounted to and accessible for stapling from the top of said reproducing apparatus adjacent a restacking tray for copied documents also provided on top of said reproducing apparatus.

8. In a reproducing method in which a reproducing apparatus automatically staples output sets of reproduction sheets with an intermittently electrically driven finishing stapler at a sets finishing area into which said output sets are automatically fed, which finishing stapler is intermittently driven by a stapler power supply providing driving power thereto; the improvement comprising:

providing a separate, additional, electrically driven convenience stapler at a separate easily manually exteriorly accessible location of said reproducing apparatus, into which convenience stapler sheets are manually insertable for stapling, electrically driving said separate convenience stapler with said same stapler power supply, in response to said manual sheet insertion, on a controlled non-coincident basis relative to said driving of said finisher stapler, by inhibiting operation of said convenience stapler for a brief inhibition time period when said stapler power supply is providing said driving power for said finisher stapler, which inhibition time period is sufficiently brief that there is no significant operator-perceptible time delay in said operation of said separate convenience stapler on operator demand.

9. The reproducing method of claim 8, wherein said brief inhibition time period of said convenience stapler corresponds to the time period required for said stapler power supply to generate and then provide a stapler driving pulse to said finisher stapler.

10. The reproducing method of claim 8, wherein said inhibition time period starts before the time at which said finisher stapler is electrically driven.

11. The reproducing method of claim 8, wherein said inhibition time period of said convenience stapler has a maximum time period of approximately one second or less.

12. The reproducing method of claim 8, wherein said inhibition time period occurs only if said demand of said separate convenience stapler occurs during a time period required for said stapler power supply to generate and provide a stapler driving pulse to said finisher stapler, and wherein said time periods required for said stapler power supply to generate and provide a stapler driving pulse to said finisher stapler occur intermittently with a periodicity substantially greater than said brief inhibition time period.

13. The reproducing method of claim 8, wherein said automatic operation of said finisher stapler always has priority over said operation of said separate convenience stapler to avoid any delay in said outputting of reproduced sets by said reproducing apparatus.

* * * * *